US009714155B2

(12) United States Patent
Tyni et al.

(10) Patent No.: US 9,714,155 B2
(45) Date of Patent: Jul. 25, 2017

(54) METHOD FOR CONDITION MONITORING OF ELEVATOR ROPES AND ARRANGEMENT FOR THE SAME

(71) Applicant: KONE Corporation, Helsinki (FI)

(72) Inventors: Tapio Tyni, Hyvinkää (FI); Hannu Lehtinen, Numminen (FI); Riku Lampinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 443 days.

(21) Appl. No.: 14/531,539

(22) Filed: Nov. 3, 2014

(65) Prior Publication Data

US 2015/0129367 A1 May 14, 2015

(30) Foreign Application Priority Data

Nov. 13, 2013 (EP) ..... 13192622

(51) Int. Cl.
*B66B 1/34* (2006.01)
*B66B 3/00* (2006.01)
*B66B 7/12* (2006.01)

(52) U.S. Cl.
CPC ..... *B66B 3/00* (2013.01); *B66B 7/1215* (2013.01)

(58) Field of Classification Search
CPC ..... B66B 3/00; B66B 7/1215
(Continued)

(56) References Cited

U.S. PATENT DOCUMENTS 6,073,728 A * 6/2000 Olsen ..... B66B 7/123 187/250
6,325,179 B1 * 12/2001 Barreiro ..... B66B 5/0037 187/393

(Continued)

FOREIGN PATENT DOCUMENTS

| | | |
|---|---|---|
| EP | 2303749 B1 | 2/2013 |
| JP | 11-35246 A | 2/1999 |
| JP | 2009-113931 A | 5/2009 |

*Primary Examiner* — Anthony Salata
(74) *Attorney, Agent, or Firm* — Birch, Stewart, Kolasch & Birch, LLP

(57) ABSTRACT

A method is provided for condition monitoring of a rope of an elevator including an elevator car and a rope wheel arrangement, which rope is connected to the elevator car and passes around at least one rope wheel included in the rope wheel arrangement. The method includes obtaining travel data of the elevator car, the travel data including information describing occurrence(s) of car start(s) and/or bypass(es); and determining based on the travel data a total number of car visits at a predetermined landing in the path of the elevator car, which total number is the sum of the number of starts of the elevator car away from said predetermined landing so as to travel to any other landing irrespective of the traveling direction, and the number of times the elevator car has bypassed said predetermined landing without stopping irrespective of the traveling direction; and comparing the total number or a multifold of the total number with a first predetermined limit value, wherein said multifold equals to the total number multiplied with factor n wherein n equals the number of said at least one rope wheel; and performing one or more predetermined action if said total number or the multifold of the total number meets the first predetermined limit value, said one or more action including one or more
(Continued)

of indicating a weakened rope condition, indicating a need for maintenance or replacement of elevator rope(s), calculating an estimated moment of maintenance or replacement of elevator rope(s), sending a specific or general warning signal, sending a fault signal, sending a signal to a service center the signal indicating weakened rope condition or a need for maintenance or a need for replacement of elevator rope(s). An arrangement implements the method.

20 Claims, 2 Drawing Sheets

(58) Field of Classification Search
USPC ..... 187/391, 393, 394; 324/512, 533; 73/158; 702/33, 34, 79
See application file for complete search history.

(56) References Cited

U.S. PATENT DOCUMENTS

| | | | | |
|---|---|---|---|---|
| 6,330,935 | B1 * | 12/2001 | Systermans | B66B 5/0025 187/391 |
| 6,330,936 | B1 * | 12/2001 | Lence Barreiro | B66B 5/0025 187/247 |
| 6,543,583 | B1 * | 4/2003 | Lence Barreiro | B66B 5/0025 187/316 |
| 7,937,283 | B2 * | 5/2011 | Tyni | G06Q 10/06 705/305 |
| 8,807,286 | B2 * | 8/2014 | Puranen | B66B 5/0018 187/391 |
| 9,580,276 | B2 * | 2/2017 | Toutaoui | B66B 1/3461 |
| 2011/0172932 | A1 | 7/2011 | Bachmann et al. | |
| 2012/0255150 | A1 * | 10/2012 | Alasentie | B66B 19/02 29/401.1 |
| 2015/0362450 | A1 * | 12/2015 | Lehtinen | B66B 19/02 187/391 |

* cited by examiner

METHOD FOR CONDITION MONITORING OF ELEVATOR ROPES AND ARRANGEMENT FOR THE SAME

FIELD OF THE INVENTION

The invention relates to condition monitoring of a rope of an elevator, which elevator is in particular meant for transporting passengers and/or goods.

BACKGROUND OF THE INVENTION

In elevators, the ropes connected to the elevator car are generally guided by rope wheels. The ropes pass around the rope wheel bending against the rim thereof. During car travel, the ropes connected to the car continuously run around the rope wheel. Any section of the rope that runs over the rope wheel undergoes a bending cycle, which involves bending into a curved shape and a a subsequent straightening. The ropes normally endure without breaking several hundred thousand bending-cycles. However, the ropes are not allowed to be used until they break. The ropes need to be monitored, maintained and replaced with new ones early before breaking so as to avoid hazardous situations. The need for maintenance or replacement of ropes has been determined either by visual inspection or by complicated algorithms associating rope sections and determining bends undergone by each point of rope. One method according to prior art is disclosed in a European patent document EP2303749B1. Generally, visual inspection is troublesome and inaccurate way of monitoring the condition of the ropes. The use of complicated algorithms, on the other hand, leads to complicated programs, and their implementation is likely to require additional processor capacity for the elevator. Furthermore, algorithms according to the prior art, have necessitated a very specific association process of associating each of plural specific rope sections to one bending counter counting bendings of that specific rope section. This association process, as well as the overall method has been complicated and difficult to perform, and it produces information which is complicated to evaluate. It has come up a need for an efficient and simple, yet reasonably reliable way of determining rope condition.

BRIEF DESCRIPTION OF THE INVENTION

The object of the invention is, inter alia, to solve previously described drawbacks of known solutions and problems discussed later in the description of the invention. An object of the invention is to introduce a new method as well as an elevator implementing an improved way of rope condition monitoring. An object is, in particular, to provide a new method as well as an elevator, which can in a simple, yet reasonably reliable way assess the condition of the ropes of an elevator. Embodiments are presented, inter alia, where unnecessary rope condition monitoring work can be omitted. In particular, embodiments are presented, where at least the most critical section of each rope is monitored indirectly, whereby direct or indirect monitoring of less critical sections of these ropes can be omitted.

It is brought forward a new method for condition monitoring of a rope of an elevator comprising an elevator car and a rope wheel arrangement, which rope is connected to the elevator car and passes around at least one rope wheel comprised in the rope wheel arrangement. The method comprises obtaining travel data of the elevator car. The travel data is preferably such that it includes information describing occurrence(s) of car start(s) and/or bypass(es). The method further comprises determining based on the travel data a total number of car visits at a predetermined landing in the path of the elevator car, which total number is the sum of the number of starts of the elevator car away from said predetermined landing so as to travel to any other landing irrespective of the traveling direction, and the number of times the elevator car has bypassed said predetermined landing without stopping irrespective of the traveling direction. The method further comprises comparing the total number or a multifold of the total number with a first predetermined limit value, wherein said multifold equals to the total number multiplied with factor n wherein n equals the number of said at least one rope wheel. The method further comprises performing one or more predetermined action if said total number or the multifold of the total number meets the first predetermined limit value, said one or more action including one or more of indicating a weakened rope condition, indicating a need for maintenance or replacement of elevator rope(s), calculating an estimated moment of maintenance or replacement of elevator rope(s), sending a specific or general warning signal, sending a fault signal, sending a signal to a service center the signal indicating weakened rope condition or a need for maintenance or a need for replacement of elevator rope(s). The method is simple, as it takes account in a minimalistic fashion all the relevant data that is needed to provide a number that is simple to compare to a limit value. An advantage is, that the method does not necessitate counting of great number of different type of occurrences, nor does it necessitate complicated steps of discrimination. Thereby, it can use fundamental data easily obtainable from any elevator, the data being such that it is already available in many existing elevators. In particular, the new method for rope condition monitoring can be carried out without need for multiple complicated process steps. Furthermore, the method, even though very simple, can provide reliable monitoring of rope condition. The method is advantageous also for the reason that it is easy to implement in new and existing elevators, and independent of the landing the visits of which are being followed. There is no need for inspecting the ropes visually nor associating a specific rope section to the visit number. In the simplest mode, there is no need to determine whether during a journey of the car a particular portion indeed passes over the rope wheel or not. Instead, it is assumed that car visits as defined reflect the number of bends of certain rope section without need to know specifically which rope portion this is.

In a further refined embodiment, the total number of car visits at a predetermined landing in the path of the elevator car consists of the sum of the number of starts of the elevator car away from said predetermined landing so as to travel to any other landing irrespective of the traveling direction, and the number of times the elevator car has bypassed said predetermined landing without stopping.

In a further refined embodiment, the predetermined landing is a lobby landing of the building.

In a further refined embodiment, the predetermined landing is a lobby landing of the building on which a destination call device is installed.

In a further refined embodiment, the predetermined landing is an intermediate landing positioned between the lowermost and uppermost landings of the elevator.

In a further refined embodiment, said predetermined landing is the entrance lobby landing of the building.

In a further refined embodiment, the travel data is obtained at least partly from car position data. Preferably, for this purpose said step of obtaining includes a step of processing raw data, which is in this case car position data, so as to generate the travel data including the aforementioned information from the car position data.

In a further refined embodiment, the method comprises monitoring car position so as to obtain said car position data.

In a further refined embodiment, the car position is monitored by means of a car position sensing arrangement.

In a further refined embodiment, if said total number meets a second predetermined limit value, which is higher than the first predetermined limit value, the elevator is removed from passenger use.

In a further refined embodiment, said obtaining, determining and comparing are each performed repeatedly during use of the elevator so as to accomplish the comparison with an updated total number of car visits.

In a further refined embodiment, a cycle of said obtaining, determining and comparing is performed repeatedly so as to accomplish the comparison with an updated total number of car visits, repeating of this cycle preferably being triggered every time either the car start from said predetermined landing or a bypassing of said predetermined landing is realized.

In a further refined embodiment, said sum is determined by counting the starts of the elevator car away from said predetermined landing so as to travel to any other landing irrespective of the traveling direction, and the number of times the elevator car has bypassed said predetermined landing without stopping, in particular by increasing the sum by one each time said start or bypass occurs.

It is also brought forward a new arrangement for condition monitoring of a rope of an elevator, which rope is connected to an elevator car and passes around at least one rope wheel of a rope wheel arrangement. The arrangement comprises a processing unit arranged to obtain travel data of the elevator car, the travel data preferably including information describing occurrence(s) of car start(s) and/or bypass(es), and to determine based on the travel data a total number of car visits at a predetermined landing in the path of the elevator car, which total number is the sum of the number of starts of the elevator car away from said predetermined landing so as to travel to any other landing irrespective of the traveling direction, and the number of times the elevator car has bypassed said predetermined landing without stopping; and to compare the total number of car visits obtained by said determining or a multifold of the total number obtained by said determining with a first predetermined limit value, wherein said multifold equals to the total number multiplied with factor n wherein n equals the number of said at least one rope wheel; and to perform one or more predetermined action if said total number or the multifold of the total number meets the first predetermined limit value, said one or more action including one or more of indicating a weakened rope condition, indicating a need for maintenance or replacement of elevator rope(s), calculating an estimated moment of maintenance or replacement of elevator rope(s), sending a specific or general warning signal, sending a fault signal, sending a signal to a service center the signal indicating weakened rope condition or a need for maintenance or a need for replacement of elevator rope(s).

The elevator as described anywhere above is preferably, but not necessarily, installed inside a building. It is of the type where the elevator car is arranged to serve two or more landings. The car preferably responds to calls, such as destination calls from landing and/or destination commands from inside the car so as to serve persons on the landing(s) and/or inside the elevator car. Preferably, the car has an interior space suitable for receiving a passenger or passengers, and the car can be provided with a door for forming a closed interior space. Thereby, it is well suitable for serving passengers.

BRIEF DESCRIPTION OF THE DRAWINGS

In the following, the present invention will be described in more detail by way of example and with reference to the attached drawings, in which.

DETAILED DESCRIPTION

Figure 1:
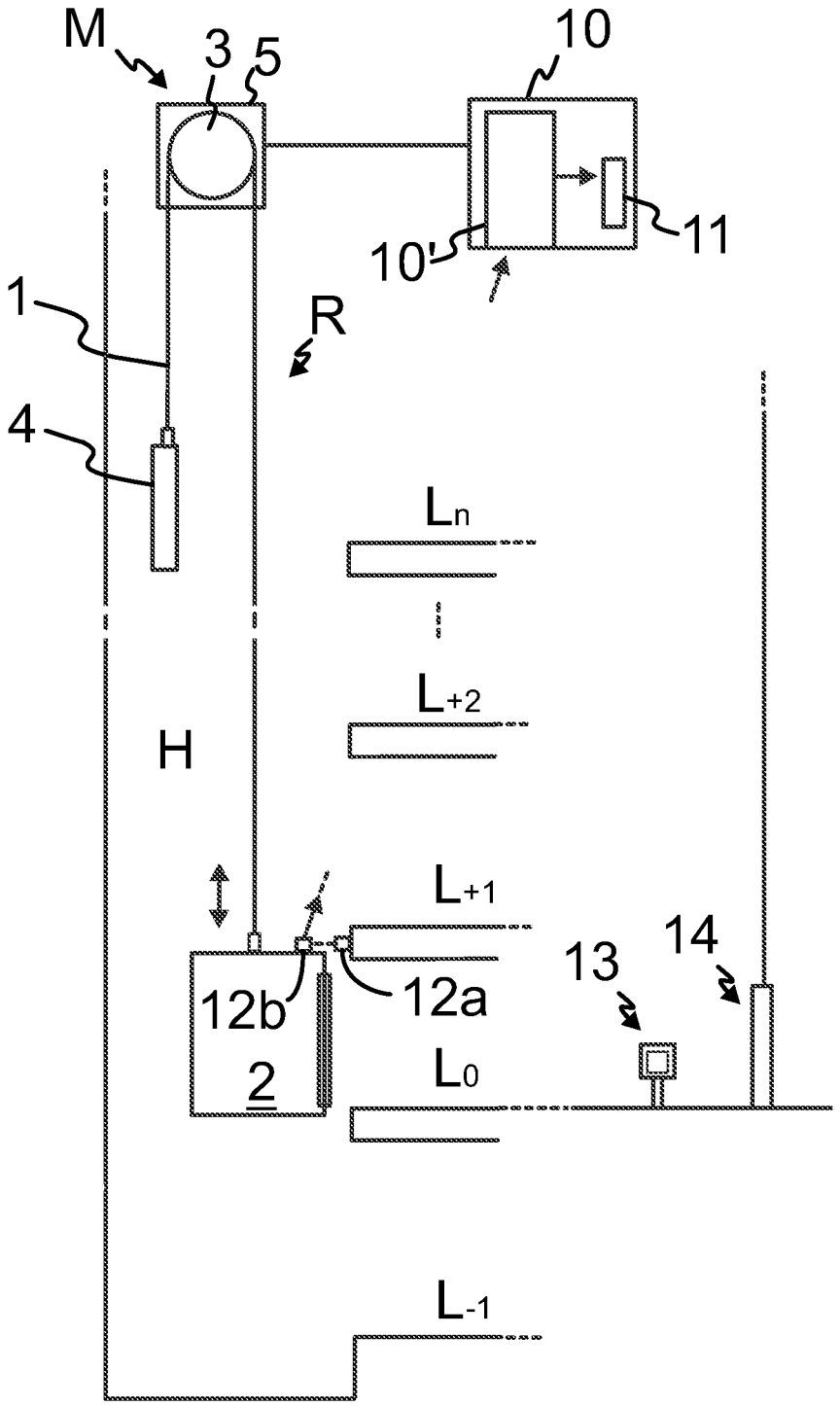
FIG. 1 illustrates schematically an elevator according to a preferred embodiment of the invention implementing a method according to a preferred embodiment of the invention.

FIG. 1 illustrates an elevator implementing a method for condition monitoring of an elevator rope 1. The elevator comprises a hoistway H, and an elevator car 2 and a counterweight 4, which are vertically movable in the hoistway H. The elevator further comprises a rope wheel arrangement M, and a roping R, which comprises a rope 1 or several of them, each of which passes around a rope wheel 3 guiding the passage of the rope 1. Said ropes 1 are in the illustrated embodiments suspension ropes. Said rope 1 is connected to the elevator car 2, whereby the rope 1 continuously runs over the rope wheel 3 during vertical movement of the car 2 upwards or downwards. The rope 1 passes around the rope wheel 3 bending against the rim thereof. Thereby, any section of the rope that runs over the rope wheel 3 undergoes a bending cycle, which involves bending into a curved shape and a subsequent straightening.

In a first alternative, the rope 1 is monitored indirectly by first obtaining a total number N of car visits at a predetermined landing in the path of the elevator car 2 and thereafter comparing this total number N with a predetermined limit value. This logic works fine regardless of how many of said rope wheels 3 the elevator has. The limit has been predetermined to suit for the specific elevator configuration, e.g. by choosing the value for the limit from a table preferably formed based on experience or tests. The value of the limit value depends on the specifics of the rope 1 itself, but also on the configuration of the elevator, in particular the number of rope wheels of the rope wheel arrangement M. The aforementioned logic is most useful in case the elevator has only one of said rope wheels 3, because in that case the total number N is as such an approximate number of actual bending-cycles the rope section has undergone. This is convenient as the total number of visits is directly comparable with a limit value of the rope 1, which is chosen to be the actual number of bending-cycles the rope is allowed to go through before triggering predefined actions which are specified elsewhere in the application. In case the elevator has several of said rope wheels 3, the limit value, as predetermined to suit for this specific elevator configuration, is of course for a given rope 1 smaller than that for the elevator with only one rope wheel 3. In particular, it is preferable that the limit value is then the actual number of bending-cycles the rope is allowed to go through before triggering predefined actions as divided with the number of rope wheels 3. Thereby, with several rope wheels 3 the total number of visits is directly comparable with the limit value of the rope 1. Furthermore, in the method, if it is found out in the comparison that the total number N meets the first predetermined limit value, one or more predetermined action is performed. The predetermined action may be one or more of those given elsewhere in the application.

Figure 2:
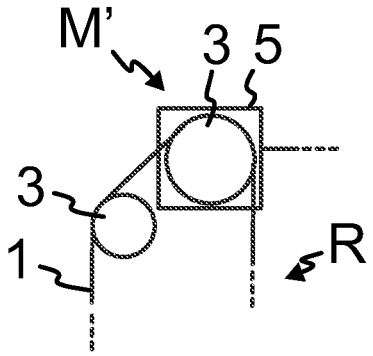
FIG. 2 illustrates schematically an alternative rope wheel arrangement for the elevator of FIG. 1.

In a second alternative, the rope 1 is monitored indirectly by first obtaining a total number N of car visits at a predetermined landing in the path of the elevator car 2 and thereafter comparing a multifold of the total number N with a predetermined limit value (also referred to as the first predetermined limit value). Said multifold equals to the total number N multiplied with factor n wherein n equals the number of said at least one rope wheel, whereby the multifold can be regarded to represent an approximate number of actual bending-cycles the rope section has undergone. This logic is especially useful in case there are plural (i.e. 2 or more) rope wheels 3 (as illustrated in FIG. 2), as with this logic the effect of the number of rope wheels 3 need not be taken into account when choosing the limit value. This is because the multifold of the total number N is, as such, automatically an approximate number of actual bending-cycles the rope section has undergone. This is convenient as the multifold of the total number of visits is directly comparable with a limit value of the rope 1, which is the actual number of bending-cycles the rope is allowed to go through before triggering predefined actions which are specified elsewhere in the application. In any case, it is preferable that the limit value has been predetermined to suit for the specific elevator configuration, e.g. by choosing the value for the limit from a table preferably formed based on experience or tests. This logic works fine also in case there are only one of said rope wheels 3. Thus, the logic can be utilized in different elevators and the software need not be reprogrammed for different elevators separately. Furthermore, in the method, if it is found out in the comparison that the multifold of total number N meets the first predetermined limit value, one or more predetermined action is performed. The predetermined action may be one or more of those given elsewhere in the application.

In the embodiments illustrated in FIGS. 1 and 2, the rope wheel arrangement M,M' also drives the elevator car 2 under control of an elevator control unit 10. The rope wheel arrangement M,M' in each embodiment comprises a motor 5 connected in force transmitting manner to a rope wheel 3, which is thereby rotatable by the motor 5. The rotatable rope wheel 3 engages the rope(s) 1 passing around it with friction engagement and/or with a positive engagement, whichever is chosen for the elevator. The rope(s) 1 is/are connected to the car 2, so the driving force needed for moving the car 2 can be transmitted from the motor 5 to the driven rope wheel 3 and from there further to the elevator car 2 via the rope(s) 1. The rope(s) 1 can be of any type, for example having a substantially round cross-section or belt-like, and connects the elevator car 2 and the counterweight 4 to each other. In the embodiment of FIG. 2, the rope wheel arrangement M' comprises, in addition to a rope wheel driven by the motor 5, also another rope wheel 3, which is preferably an idle wheel and meant to guide the rope(s) to descend at a desired lateral point down from the rope wheel arrangement M' thereby allowing the L-measurement of the elevator to differ from diameter of the driven rope wheel 3.

The aforementioned predetermined one or more action to be performed if the first predetermined limit value is met, may be

- indicating a weakened rope condition, and/or
- indicating a need for maintenance or replacement of elevator rope(s) 1 with new one(s), and/or
- calculating an estimated moment of maintenance or replacement of elevator rope(s) 1 with new one(s), and/or
- sending a specific warning signal (e.g. a signal including a warning code associated with rope(s)) or a general warning signal,
- sending a fault signal (e.g. a signal including a fault code associated with rope(s)),
- sending a signal to a service center the signal indicating weakened rope condition or a need for maintenance or a need for replacement of elevator rope(s) 1 with new one(s).

After one or more of these actions has been performed, the elevator can remain in use if there is another, higher limit value yet to be compared with the total number. In this way, after the above given action(s) has/have been performed, the maintenance personnel has a certain time to replace or maintain the ropes until the second limit value is met. For this purpose, the first limit value is chosen to be smaller than the ultimate limit of allowed total visit number N. The steps of obtaining, determining and comparing are repeated, e.g. in the same way as before meeting the first limit value, and if said total number N meets a second predetermined limit value, which is higher than the first predetermined limit value, the elevator is removed from passenger use. When this second value is met in the comparison, it is not safe to have the elevator any more in passenger use.

The total number N of car visits at a predetermined landing in the path of the elevator car 2 is the sum of the number of starts of the elevator car 2 away from said predetermined landing $L_0$ so as to travel to any other landing $L_{-1}, L_{+1}, L_{+2} \ldots L_{-+n}$ irrespective of the traveling direction, and the number of times the elevator car 2 has bypassed said predetermined landing $L_0$ without stopping, irrespective of the traveling direction during the bypass. Thereby, the method simply takes into account in a minimalistic fashion all the most relevant data. As there is no necessity for any additional actions to be taken into account, no additional numbers need to be summed to this total number. Thereby, it is preferable that the total number N consists of the sum of the number of starts of the elevator car 2 away from said predetermined landing $L_0$ so as to travel to any other landing $L_{-1}, L_{+1}, L_{+2} \ldots L_{-+n}$ irrespective of the traveling direction, and the number of times the elevator car 2 has bypassed said predetermined landing $L_0$ without stopping.

It is preferable, that said determination of the total number is performed not only once but repeatedly, i.e. updated, during the elevator use. In a simple solution, said sum is determined by counting the starts of the elevator car 2 away from said predetermined landing $L_0$ to travel to any other landing $L_{-1}, L_{+1}, L_{+2} \ldots L_{-+n}$, irrespective of the traveling direction, as well as the number of times the elevator car 2 has bypassed said predetermined landing $L_0$ without stopping, in particular by increasing the sum by one each time said start or bypass occurs. Said determination is preferably performed by a computer program run on a processing unit, such as a microprocessor unit 11, which preferably forms part of the elevator control 10, whereby no separate processing unit is necessary. Said determination is preferably implemented at least partly by a counter accumulating the starts and bypasses. The counter is preferably provided by said computer program. Preferably, every time the sum is increased, also the comparison is performed. Thereby, also the comparison is performed not only once but repeatedly, i.e. updated, during the elevator use. The comparison is preferably performed by the same computer program as the aforementioned determination. It is preferable that all the steps of obtaining, determining and comparing are performed repeatedly during the elevator use. In particular, it is preferable that a complete cycle of said obtaining, determining and comparing is carried out repeatedly so as to accomplish the comparison with an updated total number N of car visits. Preferably repeating of this cycle is triggered every time either the start of the car 2 to travel to any other landing $L_{-1}$, $L_{+1}$, $L_{+2}$ . . . $L_{-+n}$ from said predetermined landing or a bypassing of said predetermined landing is realized.

As mentioned, the method comprises the step of obtaining travel data of the elevator car 2, based on which travel data said determination is performed. For making the aforementioned determination possible, the travel data obtained includes information describing occurrence(s) of car start(s) and/or bypass(es), particularly concerning said predetermined landing $L_0$. Preferably, the travel data describes the occurrence(s) of car start(s) and/or bypass(es) in a numerical form, whereby it is usable without or at most with minor processing in providing the aforementioned sum. It is not necessary (although preferable) that the travel data, as obtained, is as such useful without processing for forming the sum. For those cases, the determination step may include a step of processing the travel data, in particular so as to convert it into numerical form or derive number(s) therefrom, to be used for mathematical operation of forming the aforementioned sum. In said obtaining, the travel data including the aforementioned information (about start(s) and/or bypass(es)) can be obtained from one or more sources either as ready to be used in the subsequent step of determining, or alternatively as raw data. In the latter case, said step of obtaining further includes a step of processing raw data so as to generate the travel data including the aforementioned information from raw data. Such raw data can be for example data of occurred car journeys or car position data or the like data, e.g. in the form of statistics.

The aforementioned travel data is preferably obtained from car position data, for which purpose said step of obtaining includes a step of processing raw data, which is in this case car position data, so as to generate the travel data including the aforementioned information from the car position data. In the embodiment as illustrated in FIG. 1, the method further comprises a step of monitoring car position so as to obtain the car position data. In FIG. 1, it is illustrated that the car position is monitored by means of a car position sensing arrangement 12*a*,12*b*. The position sensing arrangement 12*a*,12*b* can be of any type suitable for this purpose, such as one using a proximity sensor 12*a* sensing whether it is level with its counterpart 12*b*. The car position data signal is sent (illustrated with an arrow) from the position sensing arrangement 12*a*,12*b* to the elevator control unit 10 and received by the elevator control unit 10, for example by the elevator controller 10' thereof, which controls the motor 5 of the elevator, and receives information of car position anyways for the elevator control functions. In case the elevator car 2 starts away from the predetermined landing so as to travel to any other landing $L_{-1}$, $L_{+1}$, $L_{+2}$ . . . $L_{-+n}$ irrespective the traveling direction, the program running on the processing unit 11 obtains an information of occurrence of the start, i.e. said travel data, from the elevator controller 10'. After obtaining this travel data including information of occurrence of the start, the total number is determined in the manner as earlier described by the processing unit 11, preferably by a counter provided by said program running on the processing unit 11, which increments an accumulated total number of visits by one. Correspondingly, in case the elevator car 2 bypasses said predetermined landing without stopping, the program running on the microprocessor unit 11 obtains information of occurrence of the bypass, i.e. said travel data, from the elevator controller 10' (illustrated with an arrow). After obtaining said travel data, which includes information of occurrence of the start and/or the bypass, the total number is again determined in the manner as earlier described by the processing unit 11, preferably by a counter provided by said program running on the processing unit 11, which increments an accumulated total number of visits by one. Thereafter, the step of comparing follows in the way as above described. Car position data can of course be acquired in alternative ways than provided by the car position sensing arrangement 12*a*,12*b*, which provides a direct measurement of the car position. For example, the car position data can be alternatively acquired from statistics of occurred car journeys or the like information.

All said travel data can be obtained from one source or from several, e.g. two, sources. For example the travel data including information describing the car starts can be obtained from different source than the travel data including information describing the bypasses. Each of said one or several sources can be any source where this kind of information can be received from.

In FIG. 1 an embodiment of an arrangement for condition monitoring of an elevator rope is illustrated in accordance with the invention, wherein an elevator rope 1 is connected to an elevator car 2 and passes around at least one rope wheel 3. FIG. 2 presents a rope wheel arrangement M' as an alternative to that of FIG. 1. The arrangement comprises a processing unit 11 arranged to obtain travel data of the elevator car 2, which travel data includes information or statistics of car position and/or starts, and to determine based on the travel data a total number of car visits at a predetermined landing in the path of the elevator car 2, which total number is the sum of the number of starts of the elevator car 2 away from said predetermined landing $L_0$ so as to travel to any other landing $L_{-1}$, $L_{+1}$, $L_{+2}$ . . . $L_{-+n}$ irrespective of the traveling direction, and the number of times the elevator car 2 has bypassed said predetermined landing $L_0$ without stopping. The processing unit 11 is further arranged to compare the total number N of car visits obtained by said determining or a multifold of the total number N with a first predetermined limit value, wherein said multifold equals to the total number N multiplied with factor n wherein n equals the number of said at least one rope wheel. The arrangement, preferably said processing unit 11 thereof, is further arranged to perform one or more predetermined action if said total number N or the multifold of the total number N meets the first predetermined limit value, said one or more action including one or more of indicating a weakened rope condition, indicating a need for maintenance or replacement of elevator rope(s) 1, calculating an estimated moment of maintenance or replacement of elevator rope(s) 1 with new ones, sending a signal to a service center the signal indicating weakened rope condition or a need for maintenance or a need for replacement of elevator rope(s) 1 with new ones. With regard to the nature of the processing unit 11, it is preferably a microprocessor unit 11, which is arranged to run a computer program performing said steps of obtaining, determining and comparing. The processing unit 11 preferably is in data transfer connection with the elevator controller 10' of the elevator control unit 10, to which also said processing unit 11 preferably belongs. So as to be able to perform the comparison, the processing unit preferably comprises a memory storing the first limit value and possibly a second limit value as specified earlier. It preferably also stores the program run by the processing unit 11. The processing unit 11 is preferably furthermore in data transfer connection (not showed) or at least suitable to establish such a connection with a means separate from said elevator, such as a service center, so as to be able to communicate information relating to the condition of the rope(s) 1 with said means separate from said elevator. The arrangement is furthermore implemented the other details of the method as described above.

It is advantageous to use in said determination of the total number of visits the number of starts of the elevator car 2 away from said predetermined landing $L_0$ so as to travel to any other landing $L_{-1}$, $L_{+1}$, $L_{+2}$ . . . $L_{-+n}$ irrespective of the traveling direction. The method is thereby simple, as it does not necessitate counting both starts and arrivals, nor any complicated discrimination of certain starts from the sum. Simply, all starts from said predetermined landing $L_0$ so as to travel to any other landing are included (counted) into the number of starts. This is advantageous also for the reason that start counters are easy to implement by a computer program running on the processing unit 11. Furthermore, starts are in some elevators counted for other purposes. In those elevators, the system need not be greatly modified as all the starts, irrespective of traveling direction, can be counted into the sum.

The number of starts of the elevator car 2 away from said predetermined landing $L_0$ so as to travel to any other landing $L_{-1}$, $L_{+1}$, $L_{+2}$ . . . $L_{-+n}$ irrespective of the traveling direction includes starts with traveling direction upwards and starts with traveling direction downwards. Also, the number of starts of the elevator car 2 away from said predetermined landing $L_0$ so as to travel to any other landing irrespective of the traveling direction includes starts irrespective of whether the traveling direction of the started run is the same or opposite to that of the preceding run. In particular, it is preferable so as to guarantee simplicity, the aforementioned number of starts of the elevator car 2 away from said predetermined landing $L_0$ so as to travel to any other landing includes all the starts of the elevator car 2 away from said predetermined landing $L_0$ so as to travel to any other landing $L_{-1}$, $L_{+1}$, $L_{+2}$ . . . $L_{-+n}$.

The aforementioned predetermined landing is preferably a lobby landing $L_0$ of the building. The lobby landing of the building is known to have most traffic in most elevator systems. Particularly preferably said predetermined landing $L_0$ is the entrance lobby landing of the building, i.e. the landing on which the exit/entrance door 14 of the building is located. Each visit of this lobby landing $L_0$ causes bending on one and same section of each of the ropes of the elevator. When the total visit number of the landing with most visits is used for the purpose of rope condition monitoring, the condition of the rope section with highest number of bendings, and thereby the condition of the rope section, which is most critical to monitor, is monitored automatically. This is performed indirectly as no visual inspection needs to take place. Neither is it necessary to be aware where the section of the rope is actually positioned in the length of the rope. There is no need to associate any specific rope section to the counted number, nor is it necessary that the actual location of the rope section with most bendings is ever determined. In FIG. 1, the predetermined landing is a lobby landing $L_0$ of the building. The lobby landing $L_0$ is the entrance lobby landing of the building, on which landing a destination call device 13 is installed. Via the destination call device 13, a passenger can give the elevator system, in particular the elevator control unit 10 thereof, a destination call according to which the elevator system, in particular the elevator control unit 10 thereof, allocates an elevator car to the passenger. The predetermined landing $L_0$ is in this case an intermediate landing positioned between the lowermost and uppermost landings of the elevator. Thereby, starts can occur towards either of the two traveling directions, but also bypasses are possible. The method is in this case particularly efficient. The method taking into account also this position of the landing of most traffic, can be implemented in any elevator, independent of where the landing whose total visits are determined and compared with a limit value is positioned. Thereby, the same system can be installed to any building. The method/arrangement can be implemented for one or more landings. Should the method be implemented for all the landings, it can be assumed that all the rope sections that can go through considerable bending are monitored.

As specified above, it is preferable that the aforementioned predetermined landing is a lobby landing $L_0$ of the building, as the lobby landing of the building is known to have most traffic in most elevator systems. However, said predetermined landing could in some elevator installation be chosen to be some other landing than lobby landing, especially if that other landing is known to have most traffic in that specific elevator system.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims. Although the method/arrangement is/are illustrated in context of a counterweighted elevator only, the method/arrangement can be utilized also for condition monitoring of rope(s) that are not connected to a counterweight, such as rope(s) of a counterweightless elevator.

The invention claimed is:

1. A method for condition monitoring of a rope of an elevator comprising an elevator car and a rope wheel arrangement, which rope is connected to the elevator car and passes around at least one rope wheel comprised in the rope wheel arrangement, the method comprising the steps of:

obtaining travel data of the elevator car;

determining based on the travel data a total number of car visits at a predetermined landing in the path of the elevator car, which total number is the sum of the number of starts of the elevator car away from said predetermined landing so as to travel to any other landing irrespective of the traveling direction, and the number of times the elevator car has bypassed said predetermined landing without stopping irrespective of the traveling direction; and comparing the total number or a multifold of the total number with a first predetermined limit value, wherein said multifold equals to the total number multiplied with factor n wherein n equals the number of said at least one rope wheel; and performing one or more predetermined actions if said total number or the multifold of the total number meets the first predetermined limit value, said one or more actions including one or more of indicating a weakened rope condition, indicating a need for maintenance or replacement of elevator rope(s), calculating an estimated moment of maintenance or replacement of elevator rope(s), sending a specific or general warning signal, sending a fault signal, sending a signal to a service center the signal indicating weakened rope condition or a need for maintenance or a need for replacement of elevator rope(s).

2. The method according claim 1, wherein the total number of car visits at a predetermined landing in the path of the elevator car consists of the sum of the number of starts of the elevator car away from said predetermined landing so as to travel to any other landing irrespective of the traveling direction, and the number of times the elevator car has bypassed said predetermined landing without stopping irrespective of the traveling direction.

3. The method according to claim 1, wherein the predetermined landing is a lobby landing of the building.

4. The method according to claim 1, wherein the predetermined landing is a lobby landing of the building on which a destination call device is installed.

5. The method according to claim 1, wherein the predetermined landing is an intermediate landing positioned between the lowermost and uppermost landings of the elevator.

6. The method according to claim 1, wherein said predetermined landing is the entrance lobby landing of the building.

7. The method according to claim 1, wherein said travel data includes information describing occurrence(s) of car start(s) and/or bypass(es).

8. The method according to claim 1, wherein the travel data is obtained at least partly from car position data.

9. The method according to claim 1, said method further comprising the step of monitoring car position so as to obtain car position data.

10. The method according to claim 1, wherein the car position is monitored by means of a car position sensing arrangement.

11. The method according to claim 1, wherein if said total number meets a second predetermined limit value, which is higher than the first predetermined limit value, the elevator is removed from passenger use.

12. The method according to claim 1, wherein said obtaining, determining and comparing are each performed repeatedly during use of the elevator.

13. The method according to claim 1, wherein a cycle of said obtaining, determining and comparing is performed repeatedly, repeating of this cycle being triggered every time either the car start from said predetermined landing or a bypassing of said predetermined landing is realized.

14. The method according to claim 1, wherein said sum is determined by counting the starts of the elevator car away from said predetermined landing so as to travel to any other landing irrespective of the traveling direction, and the number of times the elevator car has bypassed irrespective of the traveling direction said predetermined landing without stopping, by increasing the sum by one each time said start or bypass occurs.

15. An arrangement for condition monitoring of a rope of an elevator, which rope is connected to an elevator car and passes around at least one rope wheel of a rope wheel arrangement, the arrangement comprising:

a processing unit arranged to:

obtain travel data of the elevator car, and to determine based on the travel data a total number of car visits at a predetermined landing in the path of the elevator car, which total number is the sum of the number of starts of the elevator car away from said predetermined landing so as to travel to any other landing irrespective of the traveling direction, and the number of times the elevator car has bypassed said predetermined landing without stopping irrespective of the traveling direction;

to compare the total number of car visits obtained by said determining or a multifold of the total number obtained by said determining with a first predetermined limit value, wherein said multifold equals to the total number multiplied with factor n wherein n equals the number of said at least one rope wheel; and to perform one or more predetermined action if said total number or the multifold of the total number meets the first predetermined limit value, said one or more action including one or more of indicating a weakened rope condition, indicating a need for maintenance or replacement of elevator rope(s), calculating an estimated moment of maintenance or replacement of elevator rope(s), sending a specific or general warning signal, sending a fault signal, sending a signal to a service center the signal indicating weakened rope condition or a need for maintenance or a need for replacement of elevator rope(s).

16. The method according to claim 1, wherein a cycle of said obtaining, determining and comparing is performed repeatedly.

17. The method according to claim 1, wherein said sum is determined by counting the starts of the elevator car away from said predetermined landing so as to travel to any other landing irrespective of the traveling direction, and the number of times the elevator car has bypassed irrespective of the traveling direction said predetermined landing without stopping.

18. The method according to claim 2, wherein the predetermined landing is a lobby landing of the building.

19. The method according to claim 2, wherein the predetermined landing is a lobby landing of the building on which a destination call device is installed.

20. The method according to claim 3, wherein the predetermined landing is a lobby landing of the building on which a destination call device is installed.

* * * * *